US011352566B2

(12) United States Patent
Eatough et al.

(10) Patent No.: US 11,352,566 B2
(45) Date of Patent: Jun. 7, 2022

(54) CARBONACEOUS MATERIAL PROCESSING

(71) Applicant: EKOMATTER IP HOLDINGS 3 LLC, Salt Lake City, UT (US)

(72) Inventors: Craig Norman Eatough, Provo, UT (US); Jonathan S. Heaton, Mepleton, UT (US)

(73) Assignee: EKOMATTER IP Holdings 3 LLC, Draper, UT (US)

( * ) Notice: Subject to any disclaimer, the term of this patent is extended or adjusted under 35 U.S.C. 154(b) by 0 days.

(21) Appl. No.: 17/292,620

(22) PCT Filed: Dec. 12, 2018

(86) PCT No.: PCT/US2018/065098
§ 371 (c)(1),
(2) Date: May 10, 2021

(87) PCT Pub. No.: WO2020/122888
PCT Pub. Date: Jun. 18, 2020

(65) Prior Publication Data

US 2022/0010214 A1 Jan. 13, 2022

(51) Int. Cl.
*C10B 53/08* (2006.01)

(52) U.S. Cl.
CPC ..... *C10B 53/08* (2013.01)

(58) Field of Classification Search
CPC ..... C10B 53/08
See application file for complete search history.

(56) References Cited

U.S. PATENT DOCUMENTS 4,127,391 A * 11/1978 Koppelman ..... C10L 9/00 44/589
4,218,303 A * 8/1980 Finn ..... C10G 1/002 208/15
4,370,201 A * 1/1983 Lowenhaupt ..... G01N 33/222 201/1
4,765,883 A * 8/1988 Johnson ..... C10G 51/00 585/407
7,563,358 B2 * 7/2009 Stavens ..... C10G 45/64 585/475
7,785,447 B2 * 8/2010 Eatough ..... C10B 53/08 264/29.4
8,287,696 B2 * 10/2012 Kramer ..... C10B 15/02 201/4
8,585,788 B2 * 11/2013 Drozd ..... C10L 5/14 44/577
8,877,015 B2 * 11/2014 Bartek ..... C10B 53/02 585/242

(Continued)

*Primary Examiner* — Jonathan Miller
(74) *Attorney, Agent, or Firm* — Russell C. Scott

(57) ABSTRACT

In one embodiment, a method for processing carbonaceous materials that includes introducing a first source of carbonaceous material as a first feedstock into a mixer. Then, a second source of carbonaceous material is introduced as a second feedstock into the mixer. The second feedstock is one of the outputs of the processing of the carbonaceous materials. These carbonaceous materials are mixed into a single feedstock of carbonaceous materials that is customized into a predetermined material composition, and this predetermined mixture is then pyrolyzed in a pyrolyzer to produce a custom carbonaceous output. Other embodiments are also disclosed.

7 Claims, 4 Drawing Sheets

(56) References Cited

U.S. PATENT DOCUMENTS

| | | | | |
|---|---|---|---|---|
| 9,045,696 | B2 * | 6/2015 | Rugg | F23K 1/04 |
| 9,068,123 | B2 * | 6/2015 | Kramer | F02C 3/28 |
| 10,968,395 | B2 * | 4/2021 | Quanci | C10L 5/36 |
| 2008/0116052 | A1 * | 5/2008 | Eatough | C10B 53/08 201/24 |
| 2009/0272028 | A1 * | 11/2009 | Drozd | C10L 5/14 44/550 |
| 2010/0139287 | A1 * | 6/2010 | Kramer | F02C 3/28 518/700 |
| 2012/0160658 | A1 * | 6/2012 | Bartek | C10B 53/02 201/1 |
| 2012/0238645 | A1 * | 9/2012 | Rudlinger | F01K 13/00 518/700 |
| 2013/0008771 | A1 * | 1/2013 | Kramer | C10B 57/04 201/1 |
| 2016/0186063 | A1 * | 6/2016 | Quanci | C10B 57/06 201/22 |
| 2016/0186065 | A1 * | 6/2016 | Quanci | C10B 57/06 201/20 |
| 2017/0198221 | A1 * | 7/2017 | Targett | C10B 53/02 |
| 2020/0346929 | A1 * | 11/2020 | Cagigas | C09K 17/02 |

* cited by examiner

CARBONACEOUS MATERIAL PROCESSING

BACKGROUND OF THE INVENTION

1. Technical Field

The present invention relates generally to enhanced coal processing, and, more specifically, to analysis, formulation, and processing of carbonaceous materials as part of the coal processing.

2. Description of the Related Art

Coal processing systems are known in the art. Coal processing systems involving the production of coke have been known to include both "recovery" and "non-recovery methods. For example, a coal processing method is known in the art as disclosed in U.S. Pat. No. 7,785,447 issued to Eatough et al. That patent sets out concepts related to clean coal processing such as continuously producing a high-grade of coke from low-grade materials without causing a pollution problem.

In certain contemporary coal processing embodiments, a non-recovery system may be constructed. For example, in a non-recovery coal processing system, the coal processing may use incidental materials that may be produced during processing, such as gas, tar or oil, as a fuel to support the heating that may be required in coke production.

The following disclosure relates to improvements in the art that capitalize on, among other things, environmental concerns.

SUMMARY

An advanced coal processing system has been discovered that performs analysis, formulation, and processing on the fly by a method as disclosed herein. Upon viewing the present disclosure, one of ordinary skill in the art will appreciate that variations of analysis, formulation, and processing of carbonaceous materials demonstrate principles according to the present invention.

For example, in one inventive embodiment, a method is disclosed for producing custom carbonaceous materials. The method includes introducing a first source of carbonaceous material as a first feedstock into a former. This first feedstock is then modified such that the properties of the carbonaceous material allow for production of at least one transitory output. This transitory output is analyzed to determine if further modifying is desirable to produce the desired carbonaceous material output.

In variations of this method, a second source of carbonaceous material can serve as a second feedstock, the second source of carbonaceous material being a tar feedback from the carbonaceous material output.

In another variation of the disclosed embodiment, the method produces at least one transitory feedstock input from tar material that has been produced from the first source of carbonaceous material. This transitory feedstock assists in determining properties of future system feedstock materials.

In yet another variation of the disclosed embodiment, the method includes producing a custom carbonaceous material known as BTX (benzene, toluene, and xylene).

A second embodiment of the present invention includes another method for processing carbonaceous materials. The method includes introducing a first source of carbonaceous material as a first feedstock into a mixer. Then, a second source of carbonaceous material is introduced as a second feedstock into the mixer. Of note, the second feedstock is one of the outputs of the processing of the first source of carbonaceous materials. These carbonaceous materials are mixed into a single feedstock of carbonaceous materials that is customized into a predetermined material composition, and this predetermined mixture is then pyrolyzed in a pyrolyzer to produce a custom carbonaceous output.

In yet another embodiment of the present invention, another method is disclosed for producing custom carbonaceous materials. The method includes introducing carbonaceous feedstock materials into a mixer with other feedstock materials. These feedstock materials are formed and heated. The feedstock materials are then modified based on an output of the heating of the feedstock materials. This output could also arise from cooling the feedstock materials as well.

The foregoing is a summary and thus contains, by necessity, simplifications, generalizations, and omissions of detail; consequently, those skilled in the art will appreciate that the summary is illustrative only and is not intended to be in any way limiting. Other aspects, inventive features, and advantages of the present invention, as defined solely by the claims, will become apparent in the non-limiting detailed description set forth below.

BRIEF DESCRIPTION OF THE DRAWINGS

The present invention may be better understood, and its numerous objects, features, and advantages made apparent to those skilled in the art by referencing the accompanying drawings.

DETAILED DESCRIPTION

Figure 1:
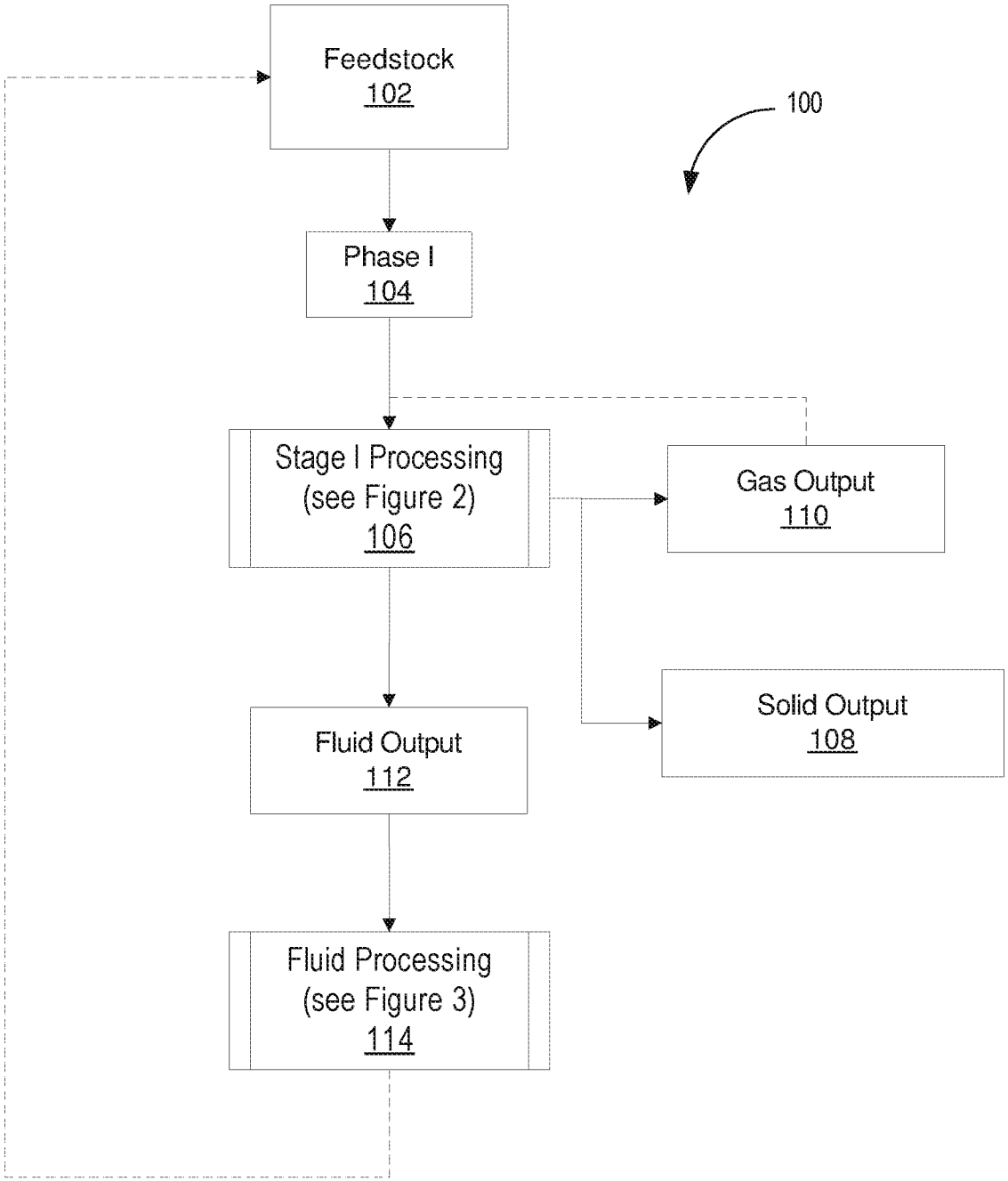
FIG. 1 is a flow diagram showing a first embodiment of a carbonaceous material custom processing system according to principles of the present invention.

The following provides a detailed description of examples of the present invention and should not be taken to be limiting of the invention itself. Rather, any number of variations may fall within the scope of the invention, which is defined in the claims following this detailed description.

Those of ordinary skill in the art will appreciate that in the development of any such actual implementation, as in any engineering or design project, numerous implementation-specific decisions must be made to achieve the developer's specific goals, such as compliance with system-related, metallurgical-related constraints, which may vary from one implementation to another. Such would be a routine undertaking of design, fabrication, and manufacture for those of ordinary skill in the art and having the benefit of the present disclosure.

In general, the disclosed process includes manipulating carbonaceous materials at a molecular level to generate a desired result. This molecular manipulation occurs during desired phases of the processing such as during pre-processing or on-the-fly processing.

This processing does not require high-quality coals to generate the desired result, rut such coals may preferred when processing for certain tars, oils, gases, or fluids. Fluids such as "coal liquids" include different types of material that those of ordinary skill in the art identify as a liquid such as BTX, aromatic oils, and so forth. Of note, BTX and other aromatic oils generated from coal are a preferred source for plastics and pharmaceuticals as opposed to aliphatic oils from petroleum.

Further, in addition to producing common coal processing byproducts such as fertilizer, the disclosed process uses feedstock material (including "young" or "old" coals) more efficiently because byproducts may be tailored use to create different levels of isotropic and mesophase pitch for ultimate generation products like carbon fiber.

Yet another example is coal blending for coke production that varies in the number of coals used. It also varies with the proportion, age, rank, composition, and geographical origin of the coal components. Coal selection and blend composition are major factors controlling physical and chemical coke properties. These factors contribute to what is sometimes referred to as devolatilization behavior.

As aids to coal selection for output quality predictions, several mathematical models are available. These can be divided into at least two groups. For example, when planning for a coke output, the first group of models focuses on the prediction of cold mechanical "met" coke strength and reactivity.

Of note, almost all of today's coal processing plants use some sort of a model to try to utilize measured coal rank, petrology, rheological properties, and ash chemistry to predict product performance and characteristics. However, in the past, trial and error testing in test ovens was required prior to operating batteries of recovery or non-recovery ovens. With such ovens, it was not even contemplated to attempt to accomplish the results predicted by the models of the present invention and to customize carbonaceous materials during processing.

Reference will now be made in detail to embodiments of the invention illustrated in the accompanying drawings. Whenever possible, the same or similar reference numerals are used in the drawings and the description to refer to same or like parts, acts, or steps. The drawings are in simplified form.

FIG. 1 is a flow diagram 100 showing a first embodiment of a carbonaceous material custom processing system according to principles of the present invention. In the illustrated embodiment, the processing begins at a Feedstock Processing Block 102. Feedstock Processing Block 102 represents the different types of feedstock that may enter the system.

For example, the feedstock may be carbonaceous materials such as different types of coals, e.g., relatively young or old coals or a mixture thereof, carbonaceous coal waste fines, or even custom formulations of carbonaceous materials from the system 100 itself in order to tweak the input feedstock to meet a desired system output.

After Feedstock Processing Block 102, a Phase I Processing Block 104 is illustrated where mixing and forming of carbonaceous materials occurs in preparation for processing at a Stage I Processing Block 106.

Stage I Processing Block 106 is illustrated as including at least two different outputs, a Solid Output 108 and a Gas Output 110. Solid Output 108, for example, could be coke such as disclosed in U.S. Pat. No. 7,785,447, while Gas Output 110 may take various forms such as a vapor that could be used as feedback to assist in tweaking the processing of the mixture that occurs in Stage I Processing Block 106.

Also illustrated in FIG. 1 is a Fluid Output 112, or a third output of Stage I Processing Block 106. Fluid Output 112 leads to a Fluid Processing Block 114 which includes further processing that may produce a feedback loop for tweaking Feedstock Processing Block 102 during system operation.

As illustrated, system outputs 108, 110, and 112 can be used to customize system operation during operation which adds a layer of output control beyond simply selecting system inputs that a system operator believes will give the desired result. Mixer ingredients are analyzed during operation, and in particular embodiments, the mixture will be customized for a future pyrolyzation step where products such as coke may be formed.

In the coke embodiment, customization can include shape, size, percentage of and type of carbonaceous fines to be used in pyrolyzation, and so forth. For example, where an operator uses the mixture to indicate the type of output that will be produced through a future pyrolyzation step, if the operator so indicates, a carbonaceous mixture may be formed into robust shells that are filled with carbonaceous fines prior to the heating step.

Figure 2:
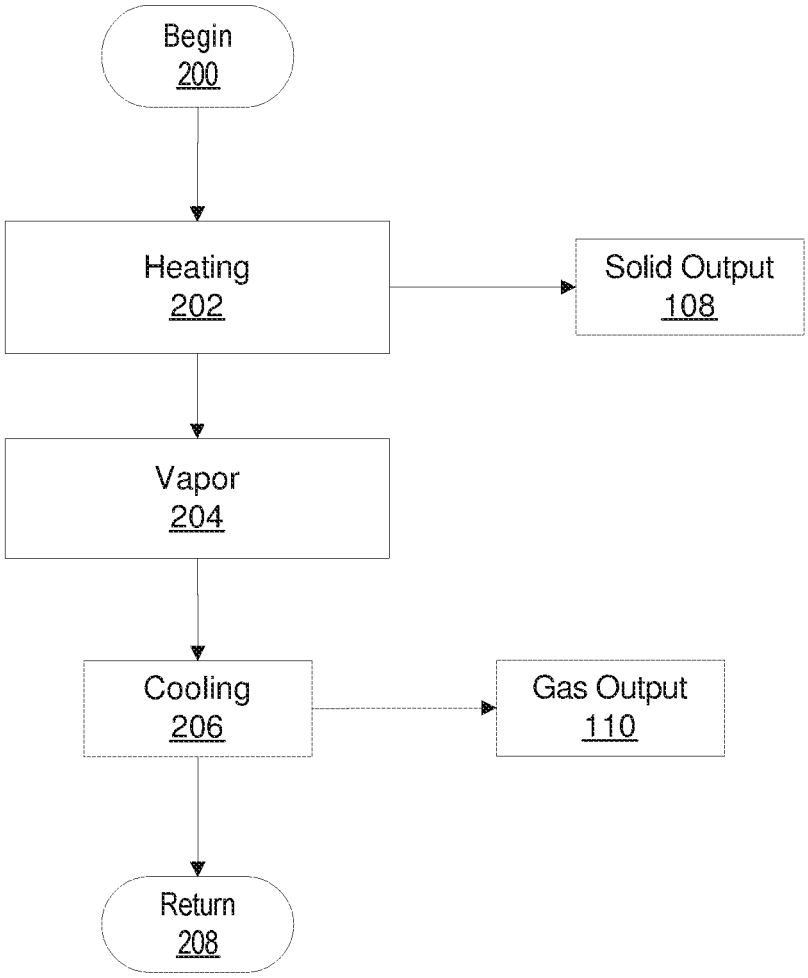
FIG. 2 is a flow diagram showing more details of the processing of FIG. 1.

FIG. 2 is a flow diagram showing more details of the Stage I Processing Block 106 of FIG. 1. In FIG. 2, Stage I Processing Block 106 begins with a Begin Oval 200 before proceeding to a Heating Processing Block 202 where Solid Output 108 is shown. For example, Stage I Processing Block 106 could be configured to produce coke that is to be produced when feedstock is heated.

Following Heating Processing Block 202 is a Vapor Processing Block 204, and then a Cooling Processing Block 206 where different coal processing elements may "fall out" such as Gas Output 108 or different coal fluids before Stage I Processing Block returns at Return Oval 208.

Figure 3:
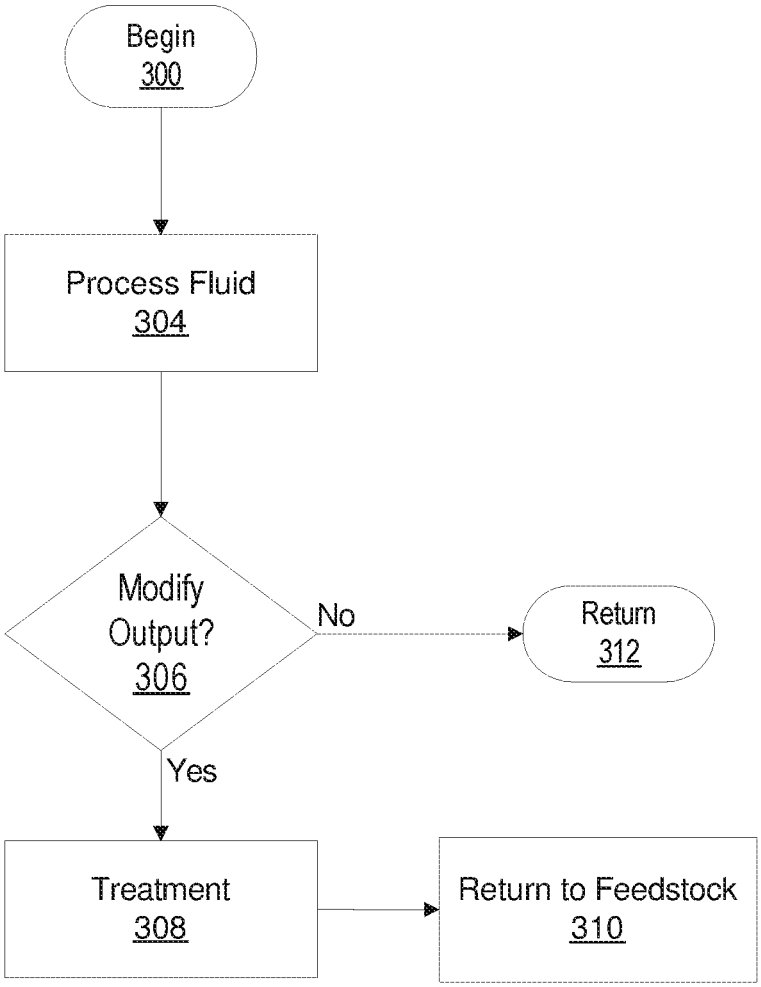
FIG. 3 is a flow diagram showing yet more details of the processing of FIG. 1.

FIG. 3 is a flow diagram showing more details of Fluid Processing Block 114 of FIG. 1. In FIG. 3, Fluid Processing Block 114 begins with Begin Oval 300 before proceeding to a Fluid Processing Block 304 where "coal liquids" are processed.

After processing is performed by Fluid Processing Block 304, a decision is made as to whether the fluid should be modified. For example, if the desired fluid output needs to be modified to obtain an isotropic pitch that can be formulated to allow for creation of material such as carbon fiber having a 1 million psi tensil strength, a Modify Output Diamond 306 offers two options for the next step.

If the "yes" branch of Modify Output Diamond 306 is taken, then Treatment Processing Block 308 is taken to modify the fluid according to the desired properties by modifying the feedstock of the system, and a Return to Feedstock Processing Block 310 is taken to implement the desired modifications.

Otherwise, "no" branch is taken at Modify Output Diamond 306, and Return Oval 312 is taken to return processing to Fluid Processing Block 114 without attempting any fluid modification.

Figure 4:
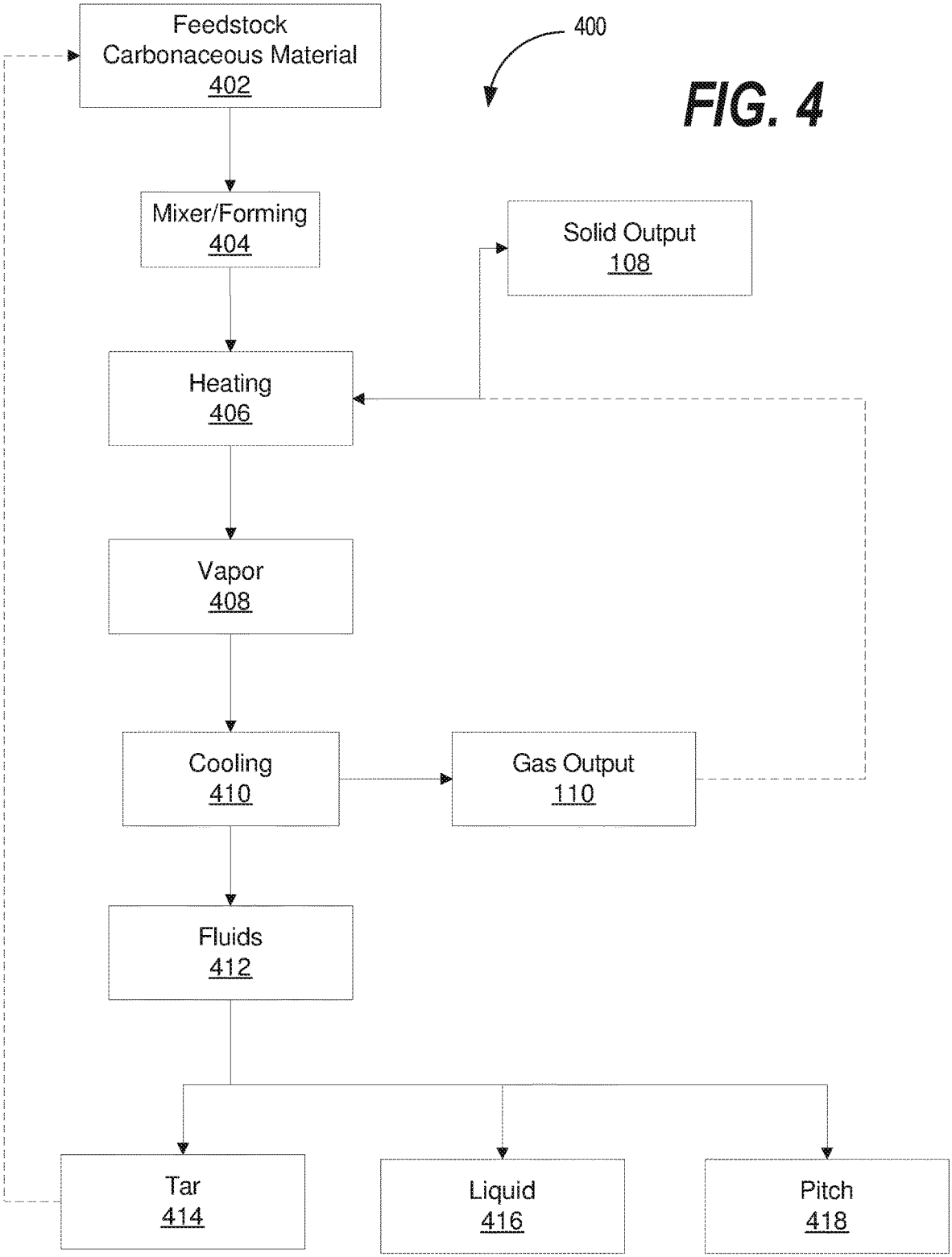
FIG. 4 is a flow diagram illustrating a second embodiment of a carbonaceous material custom processing system according to principles of the present invention.

FIG. 4 is a flow diagram 400 illustrating a second embodiment of carbonaceous material custom processing according to principles of the present invention. Processing begins at a Processing Block 402 where carbonaceous material is introduced into the system. This carbonaceous material is known as feedstock and may include carbonaceous materials such as coal, coal fines, coal processing waste products, tar, water, or aromatic oils such as BTX.

Feedstock from Feedstock Material Processing Block 402 is fed into a Mixer/Former Processing Block 404 where the carbonaceous feedstock materials are mixed and formed into a desired shape for intended purposes of the system of FIG. 4.

Mixer/Former Processing Block 404 feeds into a Heating Process Block 406 where Solid Output 108 may be produced. Heating Process Block 406 also produces vapor as shown in a Vapor Processing Block 408 which is then cooled as shown in a Cooling Process Block 410.

Cooling Process Block 410 feeds into multiple outputs which include Gas Output 110 for feeding back into Heating Process Block 406, and Cooling Process Block 410 also feeds into a Fluids Output Processing Block 412.

Fluids Output Processing Block 412 produces at least three different coal liquids—a Tar 414, a Liquid 416, and a Pitch 418. As illustrated, Tar 414 may be analyzed and found to have properties that are desirable to be fed back into Feedstock Material Processing Block 402 for tweaking of future system outputs.

Upon viewing the present disclosure, those of ordinary skill in the art will appreciate that other equivalent materials and steps could be substituted to realize the presently disclosed invention.

Although various disclosure embodiments have been described in the foregoing detailed description and illustrated in the accompanying drawings, it will be understood that the presently disclosed invention is not limited to the embodiments disclosed, but indeed may assume numerous arrangements, re-arrangements, modifications, and substitutions of elements or steps without departing from the spirit and intended scope of the invention herein set forth. The appended claims are to encompass within their scope all such changes and modifications as are within the true spirit and scope of this invention.

Furthermore, it is to be understood that the invention is solely defined by the appended claims. It will be understood by those with skill in the art that if a specific number of an introduced claim element is intended, such intent will be explicitly recited in the claim, and in the absence of such recitation no such limitation is present.

For a non-limiting example, as an aid to understanding, the following appended claims contain usage of the introductory phrases "at least one" and "one or more" to introduce claim elements. However, the use of such phrases should not be construed to imply that the introduction of a claim element by the indefinite articles "a" or "an" limits any particular claim containing such introduced claim element to inventions containing only one such element, even when the same claim includes the introductory phrases "one or more" or "at least one" and indefinite articles such as "a" or "an"; the same holds true for the use in the claims of definite articles.

What is claimed is:

1. A method for producing custom carbonaceous materials comprising:

introducing a first source of carbonaceous material as a first feedstock into a former;

modifying properties of the first source of carbonaceous material;

producing at least one transitory output from the former using the first source of modified carbonaceous material;

analyzing said at least one transitory output from the former to determine if further modifying of the first source of carbonaceous material is needed to modify the at least one transitory output to produce a predetermined output; and producing a custom carbonaceous material output from the former, wherein said producing the custom carbonaceous output further comprises producing BTX.

2. The method of claim 1 wherein the first source of carbonaceous material introduced as feedstock is coal fines.

3. The method of claim 1 wherein a second source of carbonaceous material is introduced as feedstock, wherein the second source of carbonaceous material is a tar feedstock from the custom carbonaceous material output.

4. The method of claim 1 wherein said producing at least one transitory output comprises the act of producing a tar material, the tar material being used to assist in determining exactly how to modify properties of the first source of carbonaceous feedstock materials.

5. A method for producing custom carbonaceous materials comprising:

introducing carbonaceous feedstock materials into a mixer of feedstock materials;

forming said feedstock materials;

heating said feedstock materials; and modifying said feedstock materials in a predetermined way based on output of said heating of the feedstock materials to produce custom carbonaceous materials comprising BTX.

6. The method of claim 5 further comprising cooling said feedstock materials.

7. A method for processing carbonaceous materials comprising:

introducing a first source of carbonaceous material as a first feedstock into a mixer;

introducing a second source of carbonaceous material as a second feedstock into the mixer wherein the second feedstock is one of the outputs of said processing of carbonaceous materials;

mixing at least the first and second source carbonaceous materials into a single feedstock of carbonaceous materials;

customizing said single feedstock into a predetermined material composition prior to pyrolyzation; and pyrolyzing said customized single feedstock in a pyrolyzer to produce a custom carbonaceous output comprising BTX.

* * * * *